US005385611A

United States Patent [19]

Matsumoto et al.

[11] Patent Number: 5,385,611

[45] Date of Patent: Jan. 31, 1995

[54] APPARATUS FOR FORMING RESIN COATING ON SURFACE OF ARTICLE HAVING THREE-DIMENSIONAL STRUCTURE

[75] Inventors: Yoshihiro Matsumoto, Kyoto; Mitsuhiro Shinomoto, Suita; Yasunori Yagi, Takarazuka, all of Japan

[73] Assignee: Osaka Sanso Kogyo Ltd., Osaka, Japan

[21] Appl. No.: 26,399

[22] Filed: Mar. 4, 1993

[30] Foreign Application Priority Data

Mar. 6, 1992 [JP] Japan ..... 4-049859

[51] Int. Cl.[6] ..... B05C 3/10; F26B 15/10

[52] U.S. Cl. ..... 118/642; 118/64; 118/305; 34/105

[58] Field of Search ..... 118/58, 64, 108, 207, 118/209, 641, 642, 243, 305; 34/105, 216

[56] References Cited

U.S. PATENT DOCUMENTS

| | | | |
|---|---|---|---|
| 2,133,214 | 10/1938 | Scott | 118/58 |
| 3,060,057 | 10/1962 | Johnson | 118/58 |
| 3,253,943 | 5/1966 | Mayer et al. | 118/58 |
| 3,800,433 | 4/1974 | Kubodera | 34/161 |
| 3,851,402 | 12/1974 | Turnbull et al. | 34/47 |
| 4,294,021 | 10/1981 | Turnbull et al. | 34/224 |
| 4,436,764 | 3/1984 | Nakazima et al. | 118/423 X |
| 4,442,143 | 4/1984 | Reed | 118/58 X |
| 4,508,750 | 4/1985 | Foll et al. | 427/498 |
| 4,594,266 | 6/1986 | Lemaire et al. | 427/542 |
| 4,891,241 | 1/1990 | Hashimoto et al. | 427/520 |
| 4,961,976 | 10/1990 | Hashimoto et al. | 428/34.6 |

FOREIGN PATENT DOCUMENTS

| | | |
|---|---|---|
| 0036557 | 3/1981 | European Pat. Off. . |
| 0435354 | 12/1990 | European Pat. Off. . |
| 0442735 | 2/1991 | European Pat. Off. . |
| 1182091 | 9/1957 | France . |

*Primary Examiner*—Michael W. Ball
*Assistant Examiner*—Francis J. Lorin
*Attorney, Agent, or Firm*—David A. Draegert; Larry R. Cassett

[57] ABSTRACT

An apparatus for forming a resin coating on the surface of an article having a three-dimensional structure, comprising: (i) a compartment (a) in which the surface of the article is coated with a resin solution, (ii) a compartment (b) in which said resin solution coated on said article is cured; and (iii) means for successively transporting said article through said compartments; wherein said compartment (b) is substantially shut off from the outside air and has an entrance and an exit for said article transport means, said entrance and said exit being provided with respect guide members having substantially the same cross-sectional configuration.

6 Claims, 4 Drawing Sheets

APPARATUS FOR FORMING RESIN COATING ON SURFACE OF ARTICLE HAVING THREE-DIMENSIONAL STRUCTURE

BACKGROUND OF THE INVENTION

The present invention relates to an apparatus for producing articles having a three-dimensional structure, for example, reinforced glass containers. More particularly, the present invention relates to an apparatus for forming a resin coating on the surface of an article having a three-dimensional structure.

Many glass containers are now used for selling beer or other articles in bottled form. It is preferable to minimize the wall thickness of such glass containers with a view to reducing the cost and the weight. However, if the wall thickness of glass containers is reduced excessively, the strength of the glass containers becomes weak. To reduce the wall thickness of glass containers without losing the required strength thereof, formation of a resin coating on the surface of a glass container has been studied recently. For example, European Patent Application No. 86,474 discloses a method wherein an article having a three-dimensional structure is coated with a curable resin solution, and thereafter, the resin coating is cured by irradiation with ultraviolet rays either in an inert atmosphere or in the air. The prior art literature discloses that the resin coating is cured by irradiation with ultraviolet rays in an inert atmosphere, but it contains no description about a means for preventing leakage of the inert gas and intrusion of air.

More specifically, when an ultraviolet light irradiation chamber or an electron beam irradiation chamber is maintained in an inert atmosphere (e.g., a nitrogen atmosphere), leakage of the inert gas and intrusion of air that attends the leakage must be prevented when an article to be treated is fed in and out of the irradiation chamber maintained in the inert atmosphere. If the article to be treated has a sheet-like (planar) configuration, leakage of the inert gas and intrusion of air can be readily prevented by forming a slit-shaped opening at the entrance and exit, through which the sheet-shaped article is fed in and out of the irradiation chamber. However, when an article having a three-dimensional structure, e.g., a glass bottle, is to be treated, it has heretofore been exceedingly difficult to substantially prevent leakage of the inert gas from the irradiation chamber and intrusion of air thereinto when the article is fed in and out of the irradiation chamber. For example, beer bottles vary in size and arrangement according to kinds of product. Further, when the surfaces of articles having a three-dimensional structure, e.g., glass containers are to be coated with a resin solution, it is common practice to retain a plurality (e.g., several tens) of glass containers with an article transport member and carry out coating of a resin solution, drying and curing of the resin coating for the glass containers all together in the retained state. Accordingly, there may be variations in the size and number of containers retained by the same article transport member. Therefore, it has heretofore been considered extremely difficult to prevent leakage of the inert gas from the curing chamber and intrusion of air from the outside of the chamber when such an article transport means having a complicated structure is fed in and out of the curing chamber maintained in the inert gas atmosphere. Leakage of the inert gas necessitates introduction of additional inert gas into the curing chamber, which is uneconomical. Intrusion of air causes oxidation of the unreacted resin material, lowering the degree of polymerization, and thus resulting in deterioration of the resin coating obtained.

SUMMARY OF THE INVENTION

The first invention in this application provides an apparatus for forming a resin coating on the surface of an article having a three-dimensional structure, for example, a container having a height and a cross-sectional configuration, comprising;

(i) a compartment (a) in which the surface of the article is coated with a resin solution and, if desired, drying is also carried out;

(ii) a compartment (b) in which the resin solution coated on the article is cured; and (iii) means for successively transporting the article through the compartments;

wherein the compartment (b) is substantially shut off from the outside air and has an entrance and an exit for the article transport means, the entrance and the exit being provided with respective guide members having substantially the same cross-sectional configuration, the article transport means having at least one plate member with substantially the same cross-sectional configuration as that of the guide members and at least one article retaining means so that while the article transport means is passing through each of the guide members, at least one of the plate members seals the cross-sectional portion of the guide member, and the compartment (b) is provided with at least one ultraviolet light or electron beam irradiator for irradiating the inside of the compartment (b) with ultraviolet rays or electron beam and further provided with inert gas introducing means.

The second invention in this application provides an apparatus for forming a resin coating on the surface of an article having a three-dimensional structure, comprising:

(i) a compartment (a) in which the surface of the article is coated with a resin solution and, if desired, drying is also carried out;

(ii) a compartment (b) in which the resin solution coated on the article is cured; and (iii) means for successively transporting the article through the compartments;

wherein the compartments (a) and (b) are substantially shut off from the outside air, the compartment (a) having an entrance for the article transport means, the entrance being provided with a guide member, the compartment (a) being provided with inert gas introducing means and means for recovering a solvent, monomer and/or prepolymer generated from the coating solution, the compartment (b) having an entrance through which the article transport means enters it from the compartment (a) and an exit for the article transport means, the entrance and the exit being provided with respective guide members, the three guide members having substantially the same cross-sectional configuration, the article transport means having at least one plate member with substantially the same cross-sectional configuration as that of the guide members and at least one article retaining means so that while the article transport means is passing through each of the guide members, at least one of the plate members seals the cross-sectional portion of the guide member, and the compartment (b) is provided with at least one ultraviolet light or electron means irradiator for irradiating the inside of the compartment (b) with ultraviolet rays or electron beam and further provided with inert gas introducing means.

DESCRIPTION OF THE PREFERRED EMBODIMENT

Figure 1:
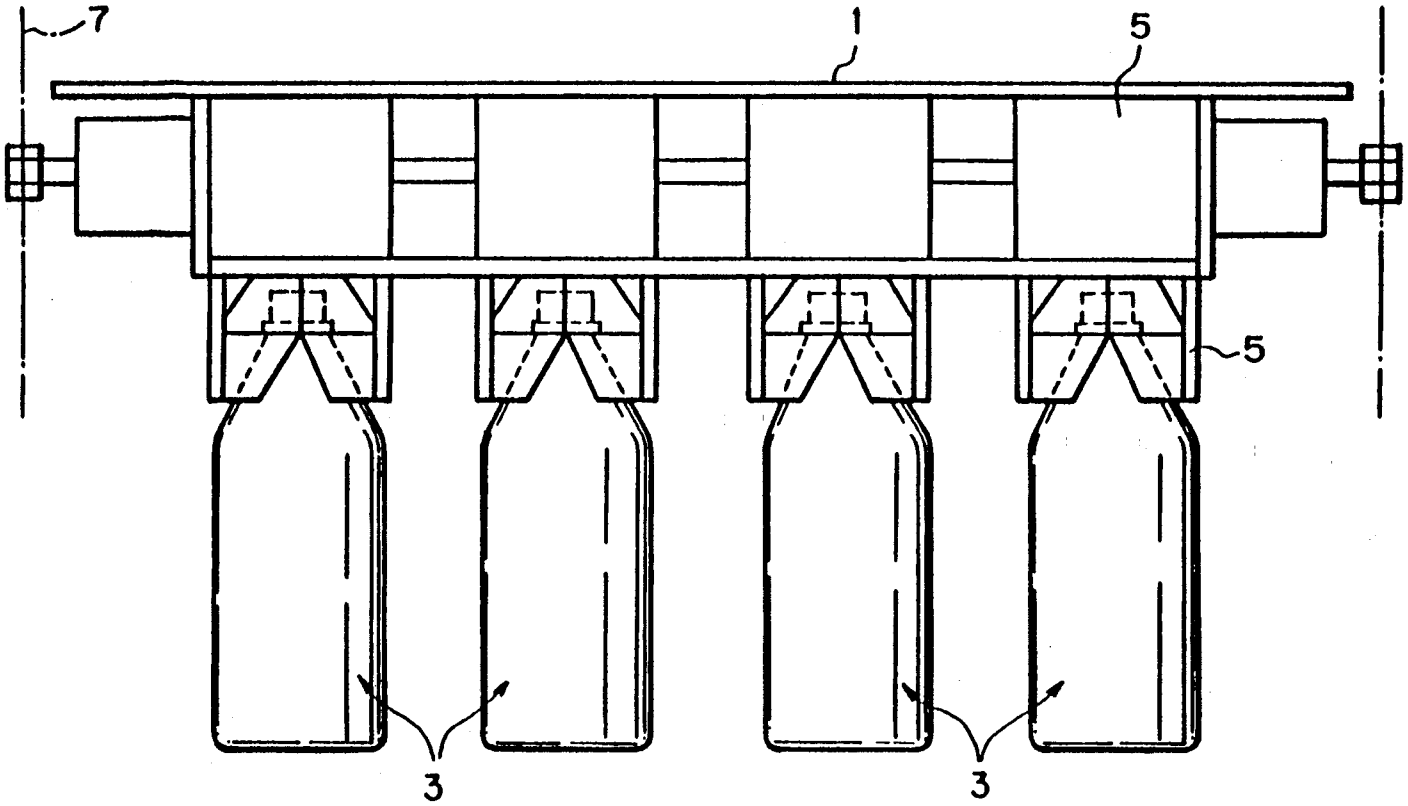
FIG. 1 is a front view of an article transport means.

The compartment for curing the resin solution may be provided additionally with means for removing the solvent, water, monomer, prepolymer and/or dust generated in the treating chamber outside the system.

When the solvent, monomer and/or prepolymer generated from the resin coating solution are to be recovered from the compartment (a), in which the surface of the article may be coated with the resin solution and, if desired, drying is also carried out, if air is present in the compartment (a) (that is, if the oxygen concentration is more than about 10%), there is a danger of explosion. Therefore, in the second invention the compartment (a) is also maintained in an inert atmosphere.

It is also possible to introduce the solvent, water, monomer and dust generated in the curing chamber, together with part of the inert gas, to an external circulating circuit from the inside of the hermetically sealed structure, and condense them for recovery by effecting temperature control, e.g., cooling, heating, etc., or attach a device for removing dust by means of a filter box, and then return the purified inert gas to the inside of the treating equipment, thereby forming a clean inert atmosphere.

It is also possible to sample the gas in the ultraviolet curing chamber and control the $O_2$ concentration with an $O_2$ analyzer such that when the $O_2$ concentration in the treating equipment exceeds a predetermined value, an inert gas is automatically introduced thereinto so as to maintain the $O_2$ concentration within a predetermined range at all times.

The inert gas introducing pipe may be attached directly to the compartment, and it may also be connected to equipment for treating the solvent and other substances.

The guide members are hollow tubular members. Every time the article transport means enters the guide member that is placed between the outside air and a compartment, some outside air enters the compartment. In general, intrusion of such a small amount of air does not prevent the apparatus from operating. However, to prevent intrusion of air substantially completely, an inert gas may be constantly blown into the tubular guide member placed between the outside air and the compartment to purge the air. In this case, evacuation of air is carried out in the gap between the inner surface of the guide member and the outer surface of the plate member of the article transport means. The guide member has an inner structure that has a depth sufficient to contain at least two plate members and a height greater than that of articles having a three-dimensional structure, which are to be treated, so that the articles can pass successively through the guide member without contacting it. As to the inert gas, it is preferable to use liquefied nitrogen gas because the gas in the ultraviolet curing chamber is initially replaced with an inert gas from the viewpoint of safety, and a nitrogen gas generator, for example, a PSA or film type nitrogen gas generator, may be provided as a backup.

The guide member may be connected to a structural member of the ultraviolet curing equipment by using flexible treated cloth, rubber, stainless flexible material, etc., and it may have a mechanism which enables the level and the opening height to be adjusted as desired. Each separator may be a plate having a slit or a bore formed in the center thereof, and it may have a structure which facilitates purging of air from the space between two separators.

The curing chamber (compartment (b)) has an entrance and an exit for the article transport means. Under certain circumstances, the coating chamber (compartment (a)) has an entrance. The entrance and the exit may be positioned horizontally, upwardly or downwardly. However, it may be necessary to provide a means for changing the angle of the retaining member so as to retain the container to be treated at a predetermined angle, depending upon the direction of the entrance and the exit.

It is also possible to supply the inert gas to the compartment (b) and circulate it from the compartment (b) to the compartment (a).

The article transport means may have two plate members which are respectively provided at the forward and rearward ends thereof. Although the plate member of the article transport means and the hollow portion of the guide member must have substantially the same cross-sectional configuration, these two members do not necessarily need to snugly fit to each other. There may be a little gap therebetween. Even if the inert gas leaks out through such a gap, there will be substantially no loss.

Similarly, the closed compartments in the present invention need not have a completely hermetically sealed structure.

The present invention will be described below in more detail with reference to the non-limiting accompanying drawings.

Figure 2:
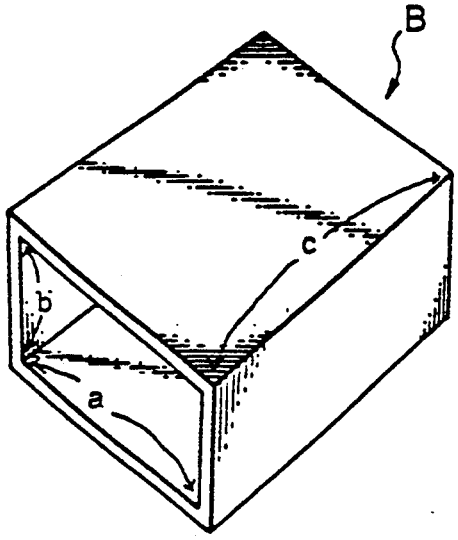
FIG. 2 is a perspective view of a guide member.
Figure 3:
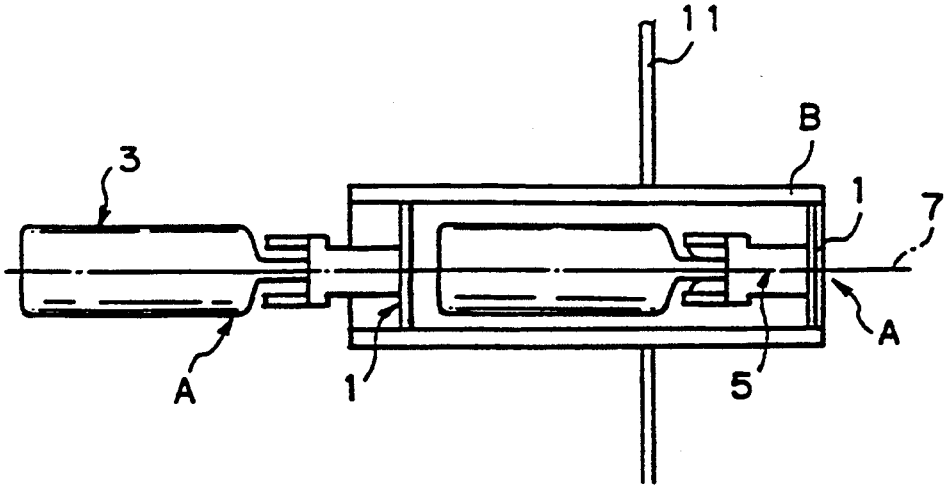
FIG. 3 shows schematically the way in which the article transport means passes through the guide member.

FIG. 1 is a front view of an article transport means A; FIG. 2 is a perspective view of a guide member B; and FIG. 3 shows schematically the way in which the article transport means A retaining articles passes through the guide member B.

Referring to FIG. 1, reference numeral 1 denotes a plate member, 5 an article retaining member, 3 a container which is to be treated, and 7 a conveyor. It is essential for the article transport member A to have the plate member 1 and the article retaining member 5 as constituent features, but it may have any desired structure. The plate member 1 may be provided at the side of the container 3. The plate member 1 may be either a flat plate or a curved plate. The plate member 1 may be made of a metal, plastics, wood, etc., and it is possible to cover the surface of the plate member 1 with cloth or the like. It is also possible to provide a single transport means B with two or more plate members 1.

FIG. 2 is a perspective view of a guide member B. The guide member B may be made of a metal, plastics, wood, etc., and it may also be covered with cloth or the like. The guide member B may be provided with an inert gas inlet (not shown) for the purpose of preventing air from entering the inside of the compartment when the article transport means A passes through the guide member B. By introduction of an inert gas, air is purged from the inside of the guide member B. If an inert gas inlet is provided, an air outlet (not shown) may be provided.

The cross-sectional configuration of the hollow portion of the guide member B is not necessarily limited to a rectangle, but it may be a circular, elliptical or any other desired configuration. The plate member 1 of the article transport means A and the hollow portion of the guide member B must have substantially the same cross-sectional configuration. However, these two members do not necessarily need to snugly fit to each other. There may be a gap therebetween. If an inert gas inlet is provided in the guide member B, the gap defined between the two members serves as an outlet for air purged. The article transport means A can retain one or a plurality of articles. The article transport means A may be connected directly to an article manufacturing process (not shown).

Referring to FIG. 3, reference numeral 11 denotes a wall of a compartment. In FIG. 3, the left-hand side of the wall 11 is the outside of the compartment, while the right-hand side of the wall 11 is the inside of the compartment. In this case, the distance between two plate members 1 provided on one article transport means A or the distance between the respective plate members 1 of a pair of adfacent article transport means A must be smaller than the length of the guide member B. With this arrangement, the plate member 1 of an article transport means A is always present inside the guide member B during the operation, thus making it possible to prevent leakage of the inert gas contained in the compartment in a large quantity and also prevent air from entering the compartment.

Figure 4:
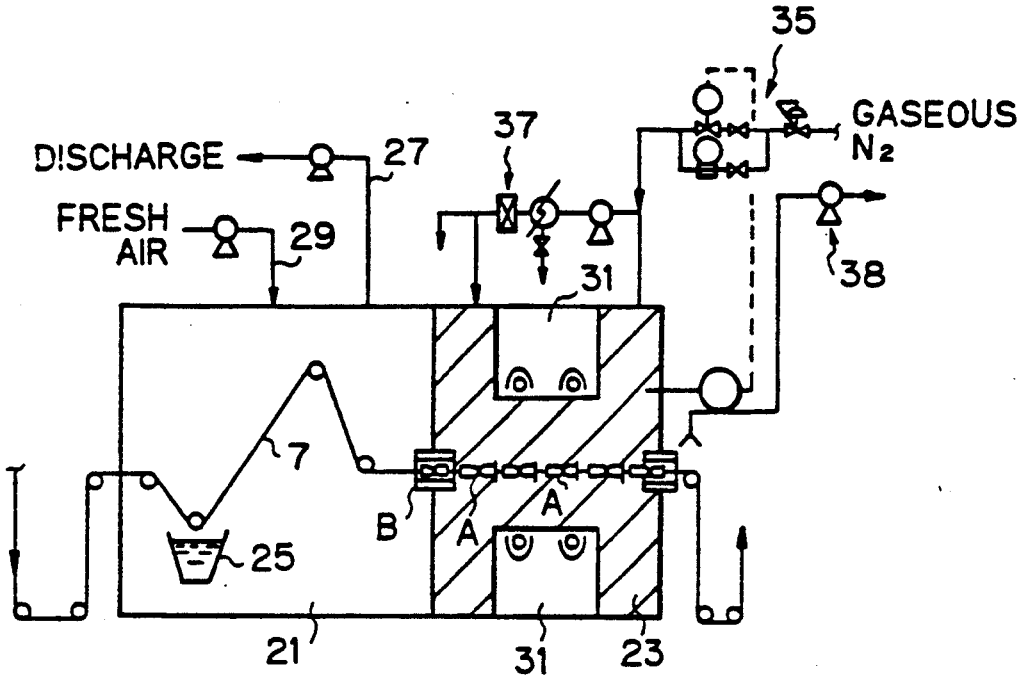
FIG. 4 is a flow sheet of a preferred apparatus for carrying out the first invention.

FIG. 4 is a flow sheet showing a preferred mode for carrying out the first invention. Reference numeral 21 denotes a compartment (a), and 23 a compartment (b). The hatched portion shows an inert atmosphere. Reference symbol A denotes article transport means.

Only some of the article transport means A are shown in the figure. Although article transport means A are present all over the conveyor 7, illustration of those which are in the compartment (a) 21 is omitted.

Articles (not shown) are carried on the conveyor 7 to enter the compartment (a) 21 where the articles are dipped in a dipping container 25 filled with a coating solution, thereby coating the surface of each article with the resin solution. The coating of the resin solution may be carried out by other means, e.g., spray coating. The resin solution on the article surface may be dried in the compartment (a) 21. The wet coating may be dried naturally or in the strong wind. Reference numeral 27 denotes an evacuation means for preventing accumulation of the solvent, monomer, etc. generated from the coating solution in the compartment (a) 21. Reference numeral 29 denotes a fresh air introducing line. After completion of the coating, each article is introduced into the compartment (b) 23 through the guide member B in a state where it is retained by the article transport means A. In the compartment (b) 23, the resin coating is cured by irradiation with an ultraviolet light irradiator 31. Subsequently, the article is delivered to the outside through a guide member B provided at the exit. The ultraviolet light irradiator 31 may be present in the inert atmosphere, but if it is necessary to cool the lamp with air, it is preferable for the irradiator 31 not to be present in the inert atmosphere. An oxygen analyzer 33 sends a signal to an inert gas introducing mechanism 35 to introduce an inert gas when the amount of oxygen in the compartment (b) 23 becomes large. Reference numeral 37 denotes a means for removing a solvent, dust, monomer, etc. whereby the inert gas having impurities removed therefrom is recirculated to the compartment (b) 23. Reference numeral 38 denotes a means for locally evacuating an inert gas. By employing the means 38, it is possible to prevent increase in the amount of an inert gas, e.g., $N_2$ gas, in the working atmosphere.

Figure 5:
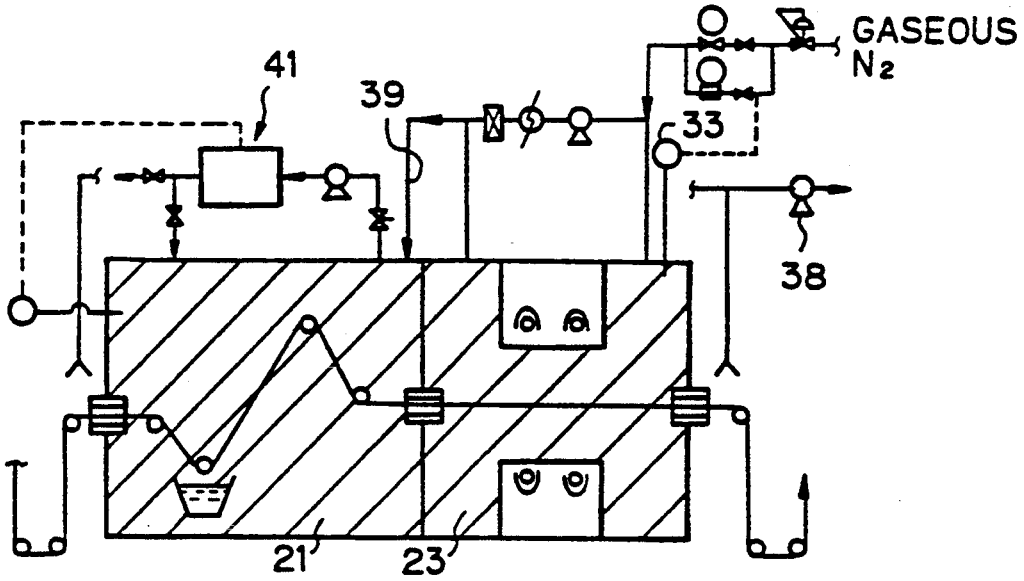
FIG. 5 is a flow sheet of a preferred apparatus for carrying out the second invention.

FIG. 5 is a flow sheet of a preferred apparatus for carrying out the second invention. The hatched portion is an inert gas atmosphere. In this case, the compartment (a) 21 is also held in the inert gas atmosphere. Therefore, a guide member B is provided at the entrance to the compartment (a) 21 through which articles are fed in from the outside air. Introduction of an inert gas into the compartment (a) 21 may be effected through an inert gas introducing line 39 which is provided separately. It is also possible to introduce the inert gas from the compartment (b) 23. In this case, the solvent, monomer, etc. in the compartment (a) 21 are recovered with a recovery device 41.

In the above-described two embodiments, the conveyor may move along a zigzag route in order to effect drying completely.

The article transport means is attached to the belt conveyor through a mechanism which is capable of varying the angle. The way of attaching the article transport means to the belt conveyor is disclosed in European Patent Application Public Disclosure No. 442,735.

Figure 6:
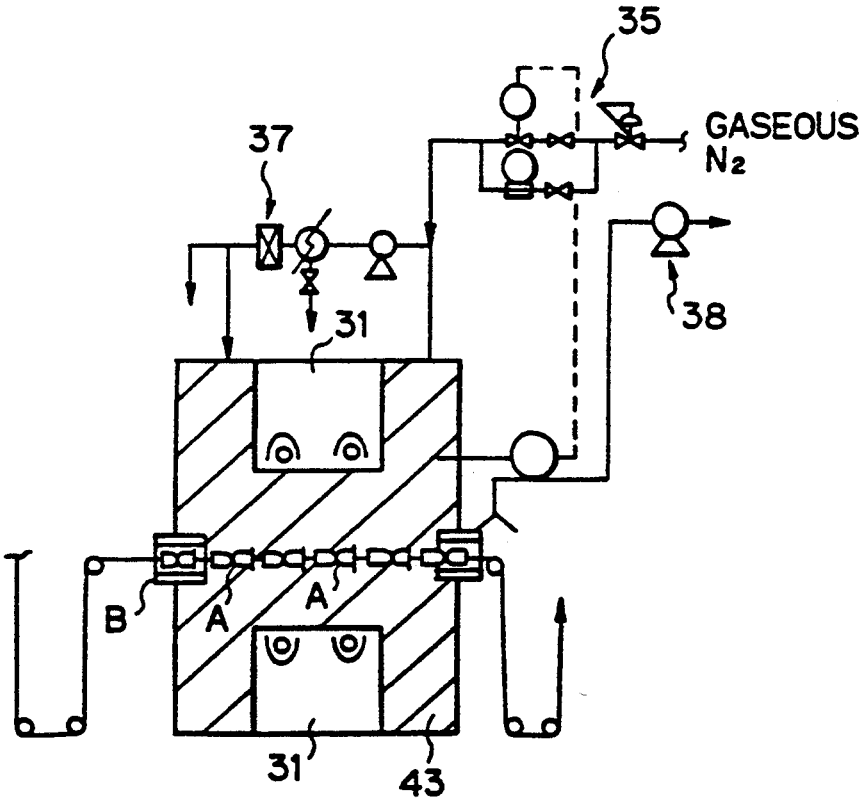
FIG. 6 is a flow sheet of a preferred apparatus for carrying out the third invention.

In a third embodiment, the present invention is applied to a case where coating of a resin solution on a glass container or the like is carried out in another apparatus. In this case, the apparatus of the present invention cures the resin material present on the surface of the container. The flow sheet of the apparatus is shown in FIG. 6. In this case, a curing chamber 43 functions in the same way as the compartment (b) 23 in the first embodiment (see FIG. 4). Therefore, description of FIG. 6 is omitted.

According to the present invention, article guide members are provided at the entrance and exit, respectively, of a closed compartment, and an article transport means has a plate member having substantially the same configuration as that of the guide members. Therefore, substantially no inert gas will leak out from the closed compartment even during the operation, and intrusion of air is also prevented.

Example 2

The apparatus shown in FIG. 4 was employed. The apparatus has a guide member as shown in FIG. 2. Guide members employed had the following dimensions:

| | Tests 1 and 3 | Test 2 |
|---|---|---|
| a | 475 mm | 475 mm |
| b | 110 mm | 110 mm |

-continued

| | Tests 1 and 3 | Test 2 |
|---|---|---|
| c | 450 mm | 300 mm |

Four of 350 cc containers were supported by an article retaining member 5. The member 5 was moved at a line speed of 5 meter/min. A resin solution was coated on the containers and dried, and then cured by ultraviolet light.

In Tests 2 and 3, the article retaining member 5 had plate member 1. The distance between one plate member and the adjacent plate member was 400 mm. In Test 2, the length (c) of guide member B was shorter than the distance of two plate members. Therefore, in Test 2, compartment (b) 23 was not completely airtight. On the other hand, in Test 3, the length (c) of guide member B was longer than the distance of two plate members, so in Test 3, compartment (b) 23 was airtight.

The results are shown in Table 1.

TABLE 1

| | Length (c) of guide member | Presence or absence of plate member | amount of $N_2$ supplied ($Nm^3$/hr.) | average conc. of $O_2$ (vol %) | variation of $O_2$ concentration (vol %) |
|---|---|---|---|---|---|
| Test 1 | 450 | No | 47 | 3.6 | 0.9–5.2 |
| Test 2 | 300 | Yes | 26 | 2.0 | 0.8–4.9 |
| Test 3 | 450 | yes | 12 | 0.8 | 0.5–1.0 |

In Test 3, the amount of $N_2$ supplied was 12 $Nm^3$/hr. in order to maintain the concentration of $O_2$ at the level less than 1% by volume. In addition, in Test 3, the variation of the $O_2$ concentration was small.

We claim:

1. An apparatus for forming a resin coating on the surface of an article having a three-dimensional structure, comprising:

(i) a compartment (a) in which the surface of the article is coated with a resin solution;

(ii) a compartment (b) in which said resin solution coated on said article is cured; and (iii) means for successively transporting said article through said compartments;

wherein said compartment (b) is substantially shut off from the outside air and has an entrance and an exit for said article transport means, said entrance and said exit being provided with respective guide members having substantially the same cross-sectional configuration, said article transport means having at least two plate members with substantially the same cross-sectional configuration as that of said guide members and at least one article retaining means so that while said article transport means is passing through each of said guide members, at least one of said plate members seals the cross-sectional portion of said guide member, and said compartment (b) is provided with inert gas introducing means.

2. The apparatus according to claim 1 wherein said compartment (b) is further provided with at least one ultraviolet light or electron beam irradiator for irradiating the inside of said compartment (b) with ultraviolet rays or electron beam.

3. An apparatus for forming a resin coating on the surface of an article having a three-dimensional structure, comprising:

(i) a compartment (a) in which the surface of the article is coated with a resin solution and;

(ii) a compartment (b) in which said resin solution coated on said article is cured; and (iii) means for successively transporting said article through said compartments;

wherein said compartments (a) and (b) are substantially shut off from the outside air, said compartment (a) having an entrance for said article transport means, said entrance being provided with a guide member, said compartment (a) being provided with inert gas introducing means, said compartment (b) having an entrance through which said article transport means enters it from said compartment (a) and an exit for said article transport means, said entrance and said exit being provided with respective guide members, said three guide members having substantially the same cross-sectional configuration, said article transport means having at least two plate members with substantially the same cross-sectional configuration as that of said guide members and at least one article retaining means so that while said article transport means is passing through each of said guide members, at least one of said plate members seals the cross-sectional portion of said guide member, and said compartment (b) is provided with inert gas introducing means.

4. The apparatus according to claim 3 wherein said compartment (a) is further provided with means for recovering at least one of a solvent, monomer or prepolymer generated from the coating solution and said compartment (b) is further provided with at least one ultraviolet light or electron beam irradiator for irradiating the inside of said compartment (b) with ultraviolet rays or electron beam.

5. An apparatus for curing a resin material on the surface of an article having a three-dimensional structure, comprising a resin curing chamber which is substantially shut off from the outside air, said chamber having an entrance and an exit for article transport means, said entrance and said exit being provided with respective guide members having substantially the same cross-sectional configuration, said article transport means having at least two plate members with substantially the same cross-sectional configuration as that of said guide members and at least one article retaining means so that while said article transport means is passing through each of said guide members, at least one of said plate members seals the cross-sectional portion of said guide member, and said resin curing chamber being provided with inert gas introducing means.

6. The apparatus according to claim 5 wherein the resin curing chamber is further provided with at least one ultraviolet light or electron beam irradiator for irradiating the inside of said chamber with ultraviolet rays or electron beam.

* * * * *